United States Patent [19]

Slavik et al.

[11] 4,015,786

[45] Apr. 5, 1977

[54] BOBBIN CHANGING APPARATUS

[75] Inventors: Valter Slavik, Horgen; Marc Meisser, Meyrin, both of Switzerland

[73] Assignee: Heberlein & Co. AG, Wattwil, Switzerland

[22] Filed: Feb. 5, 1975

[21] Appl. No.: 547,168

[30] Foreign Application Priority Data

Feb. 6, 1974 Switzerland ..... 1610/74

[52] U.S. Cl. ..... 242/35.5 A; 242/18 A; 242/18 DD

[51] Int. Cl.[2] ..... B65H 67/04; B65H 54/26

[58] Field of Search ..... 242/18 DD, 18 A, 35.5 R, 242/35.5 A

[56] References Cited

UNITED STATES PATENTS

| | | | |
|---|---|---|---|
| 3,092,340 | 6/1963 | Furst | 242/35.5 R |
| 3,370,798 | 2/1968 | Hagihara et al. | 242/18 A |
| 3,476,328 | 11/1969 | Shimai et al. | 242/35.5 R |
| 3,791,126 | 2/1974 | Kose et al. | 242/35.5 A UX |
| 3,801,030 | 4/1974 | Kobatake et al. | 242/35.5 A X |
| 3,820,730 | 6/1974 | Endo et al. | 242/35.5 R |
| 3,879,925 | 4/1975 | Yoshizawa et al. | 242/35.5 R |

*Primary Examiner*—Stanley N. Gilreath
*Attorney, Agent, or Firm*—Larson, Taylor and Hinds

[57] ABSTRACT

A textile machine having a line of bobbins to which filaments are fed continuously is provided with bobbin-exchanging device arranged to run along a rail in front of the bobbins. On reaching a bobbin holder on which a full bobbin is to be exchanged for an empty one, the device is stopped and a first arm is swivelled upwards for a holding device thereon to engage the full bobbin. Simultaneously a second arm carrying a power driven friction roller for maintaining the rotation of the full bobbin is swivelled into engagement with the full bobbin, and a third arm having an outwardly extended pivoted terminal portion carrying a device holding an empty bobbin, is swivelled upwards. The first arm is then withdrawn carrying the full bobbin past the empty bobbin while the full bobbin is being driven by the friction roller. The terminal portion of the third arm is pivoted inwards and the third arm raised further to place the empty bobbin in the bobbin holder. Means are provided on the device for opening and closing the bobbin holder to enable the exchange to take place. The bobbin holder is spring loaded to keep the bobbin, while being filled, in contact with a driving cylinder. The exchange operation may be initiated by a control device and carried through by programmed pneumatic actuating means.

7 Claims, 4 Drawing Figures

BOBBIN CHANGING APPARATUS

FIELD OF THE INVENTION

The present invention relates to a device for bobbin exchanging on textile machines to which filaments are fed continuously, the device being movable in the longitudinal direction of the machine.

In particular the invention relates to textile machines in which filaments are advanced continuously and independently of the wind-up drive. These are particularly textile machines in which the production or processing of the filaments cannot be interrupted for technical reasons, as in the case for example in false-twist texturing machines equipped with heating devices.

DESCRIPTION OF THE PRIOR ART

With most of the known bobbin-changing devices, it is rather difficult to effect bobbin changing while the filament is fed continuously and reliable bobbin changing has not hitherto been achieved in these conditions.

SUMMARY OF THE INVENTION

With a view to overcoming the aforesaid disadvantages, the invention provides a bobbin exchanging device comprising a support, an arm mounted to swivel on the support and having a holding device for the guided removal of a full bobbin, a second swivellable arm, comprising at its free end, a drivable friction cylinder for the bobbin being removed, and a third arm also swivellably connected to the support, comprising a holding device for the guided transport of an empty bobbin, and means for opening and closing the bobbin holder of the wind-up device.

DESCRIPTION OF THE DRAWINGS

An example of the invention is hereinafter described in more detail with reference to the accompanying drawings wherein, in merely schematic manner.

Figure 1:
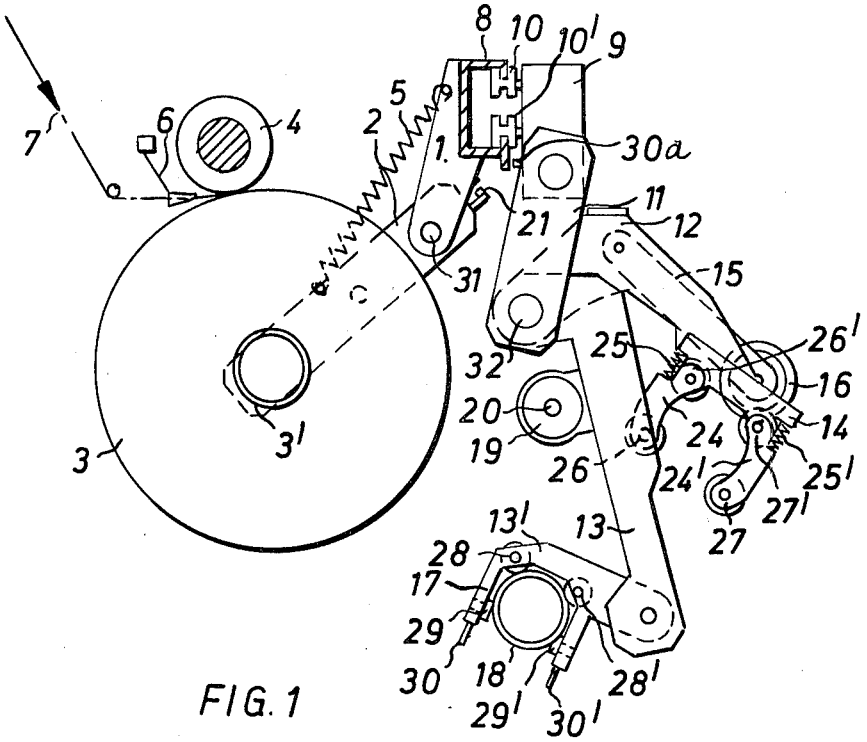
FIG. 1 shows schematically in side elevation the essential parts of a bobbin exchanging device provided on one side face of a wound-up bobbin to be exchanged together with appropriate parts of the textile machine with which the device is associated.

The parts of the bobbin exchanging device shown in the drawings, and provided on one face of a wind-up bobbin 3 are duplicated on the other face of the bobbin but are not shown.

A part 1 of a machine frame has a holder 2 (the far side holder member being shown) for the wind-up bobbin 3 mounted for rotation about a centre 31. Two such holders are provided for releasably supporting opposite axial ends of bobbin spindle or axle 3', but only the remote holder member 2 is illustrated in the drawings for clarity. A driving cylinder 4 is provided for the bobbin 3. The latter is pressed by means of a spring 5 against the driving cylinder 4. A reciprocating thread-guide 6 is provided for the filament 7 to be wound up. The apparatus thus far described and shown may be considered conventional. As to most of the parts hereinafter described, involving the bobbin exchanging device, it will be understood that the parts are duplicated in axially spaced pairs for cooperation with the axial ends of bobbin 3 and its axle or spindle 3', as well as the parts of the machine frame. The near-end elements of the bobbin exchanging device are shown and described. On the machine part 1, there is fixed a rail 8 extending along the machine on which a support 9 in the bobbin changer is guided by rollers 10, 10'. On the support 9, there is mounted a swivellable arm 11 on the free end of which there are pivoted an arm 12 carrying a holding device 14 for removing the full bobbin, and a further arm 13 carrying a holding device 17 for receiving an empty bobbin 18, the arm 13 being swivellable around a centre 32. As shown, and as viewed in the figures, arm 12 is axially relatively inward of the device relative to arm 13, such that arm 12 lies behind arm 13 as viewed in the drawings. Both arms are mounted to move between the wound bobbin 3 and the corresponding holder member 2. The holding device 14 fixed on the free end of arm 12 is forked, being provided with arms 24, 24' which can be pressed away from each other against the biasing force of springs 25, 25'. On each of ends of the arms 24, 24', there is provided rollers 26, 26', or 27, 27'.

Futhermore, a swivellable arm 15 (axially inward of arms 12 and 13 and the front end of wound bobbin 3) is mounted on the arm 12, on the free end of which there is arranged a friction roller 16 which can be rotated by means of an electric motor (not shown). Instead of being driven by an electric motor, the friction roller 16 may also be driven by an air turbine motor or by means of flexible shaft or chains driven by the driving cylinder 4. The arm 13 comprises a pivoted terminal portion 13', carrying the holding device 17, which can be swivelled upwards relatively to the arm 13 as shown in FIG. 1. The holding device 17 is also of forked shape and comprises two rollers 28, 28' as well as, at each side of the fork, a projection 29, 29' which is to prevent the inserted bobbin from falling out. At each of the fork ends of the holding device 17, there is a thread-guide 30, 30'. Furthermore, on the arm 13, there is arranged a device 19 for opening the bobbin holder 2, comprising a member 20, actuated by compressed air, which presses a portion of the bobbin holder 2 aside, which may be considered as conventional.

On the bobbin holder, there is furthermore provided an electric control device 21 which, as soon as the wind-up bobbin 3 reaches a certain diameter, triggers impulses which, through programmed control means (not shown) and through pneumatic means (not shown) actuate all the elements for bobbin changing.

Figure 2:
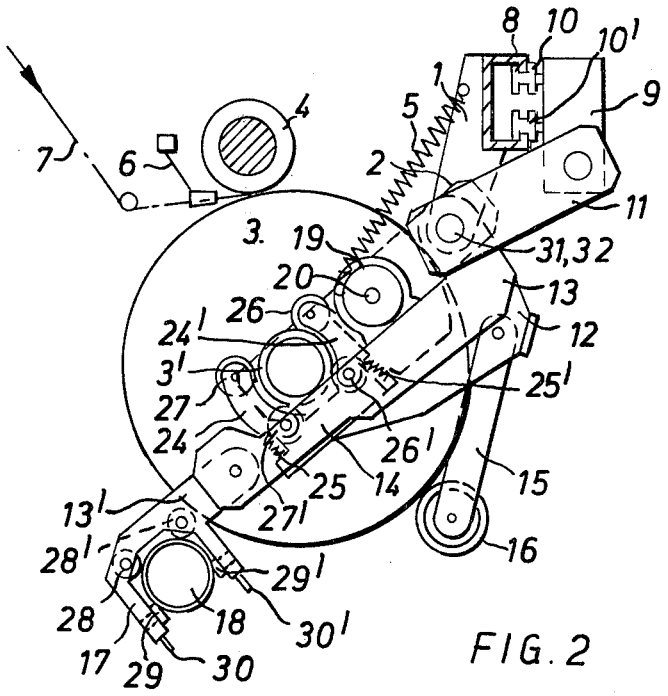
FIGS. 2 to 4 are similar to FIG. 1 showing the essential parts in three further stages in their cycle of operation.

In the initial position of the bobbin changing device shown in FIG. 1, the changing device is continuously being moved along rail 8 and, as soon as an impulse is triggered by the electrical control device 21, the changing device is stopped at the wind-up station where the bobbin is to be exchanged and fixed on rail 8 by means of a pneumatically actuated arresting bolt 30*a*. Thereafter, by the pneumatic means (not shown), successively the swivelling arms 11, 12, 13, 15 are swivelled, together with the devices 14, 16, 17, 19, into the position shown in FIG. 2 (with arms 12 and 13 located axially between the respective holder member 2 and the adjacent end of wound bobbin 3 at opposite ends of the wound bobbin, and with arms 15 and rollers 16 located such that rollers 16 engage the periphery of wound bobbin 3) and the bobbin holder opened by the compressed air acutated members 20 provided on devices 19, which bias the holder members 2 axially outwardly to release spindle 3' of wound bobbin 3. Thereby, the common rotation centre 32 of the swivelling arms 12, 13 is made coaxial with the rotation centre 31 of holder 2. The full bobbin is thus gripped by the holding devices 14, the bobbin axle 3' being received by the rollers 26, 26', 27, 27'.

Figure 3:
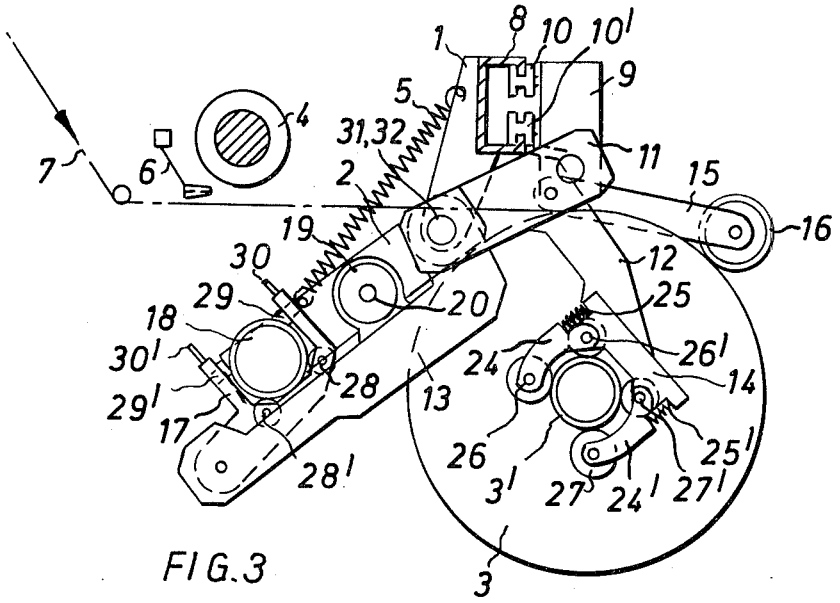

Now each arm 12 is swivelled into the position shown in FIG. 3, passing the empty bobbin 18 on the outwardly extended portion 13' and while the bobbin 3 is being driven by the rotating friction roller 16. The driving speed of the friction roller 16 may for example be controlled by the filament tension. The filament 7 which continues to be fed to the bobbin 3 is thereby removed from the thread-guide 6 and will therefore pass approximately into the middle of its reciprocating path and remain there.

Figure 4:
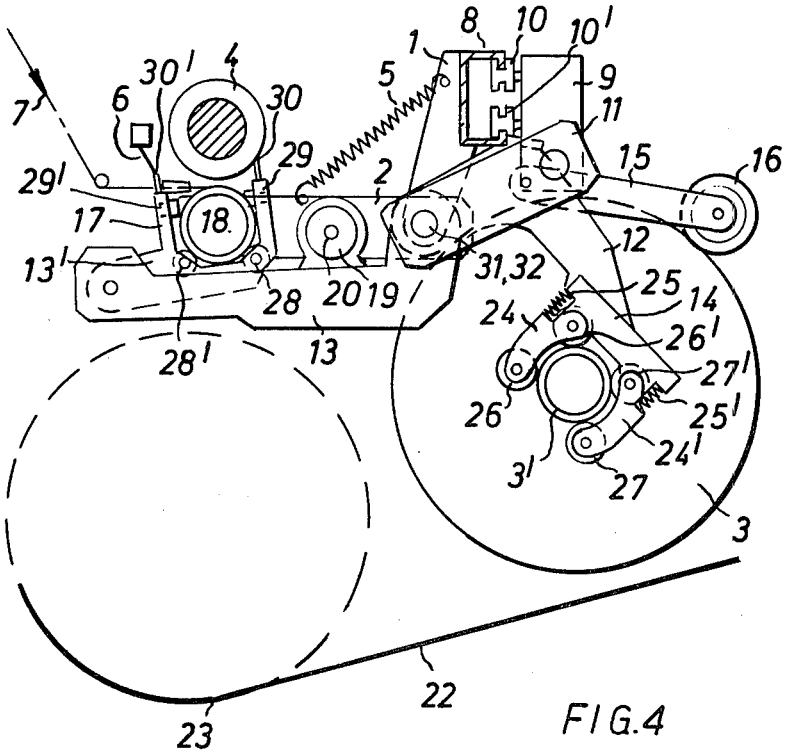

The terminal portion 13' of each arm 13 is pivoted to the position of FIG. 3 and each arm 13 is then swivelled upwards and brought into the position shown in FIG. 4 together with the empty bobbin 18 fed to the holding device 17. Thereafter, the empty bobbin 18 is put into the bobbin holder 2 and the latter is permitted to close by actuating devices 19, 20. The thread-guides 30, 30' bring the course of the filament 7 moving continuously towards the middle of bobbin 3 outside the operating range of reciprocating thread-guide 6, and more precisely to the side of the bobbin 3 where, later on, the filament reserve will be collected in any conventional known manner. Thereupon, the bobbin holder 2 is swivelled upwards and the empty bobbin 18 pressed towards the driving cylinder 4 from below by means of spring 5. The filament 7 is now taken over by the empty bobbin, a filament reserve being hereby formed in a known manner and the filament then being torn off. At the same time, the action of the electric motor (not shown), driving the friction roller 16, is interrupted. Thereby, the changing operation of bobbin 3 is terminated, and the latter rolls into a receiving device 23 over a rail 22. The bobbin 3 may however also be brought to one end of the machine by moving the changing device along the rail 8.

Depending on the type and size of the textile machine for which the device of the present invention is used, also two or more changing devices may be provided for two sided and/or multi-level bobbin exchange.

For each changing device, a separate rail extending along the machine may then be provided.

The electrical control device for indicating full bobbins may be omitted, and the changing device may be controlled so that it successively exchanges all bobbins and carries the full bobbins away.

The device of the present invention has the following advantages:

the full bobbin and the empty bobbin may be continuously driven during the whole duration of the exchanging operation, so that continuous and safe wind-up of the continuously fed filament is rendered possible; furthermore, the shells of the full bobbin and the empty bobbin are solidly and safely held by the forked holding device during the exchanging operation, and bobbins cannot fall off the holding devices or be positioned obliquely.

It will be apparent from the drawings and readily understood by those skilled in the art that sufficient axial clearance is provided between the end faces of the wound bobbin and the respective adjacent bobbin holder members to permit the described and illustrated arms and linkages of the bobbin exchanging device to move therebetween without interference, in the operational sequences described and illustrated.

We claim:

1. In a device for bobbin-exchanging on a textile machine having a line of bobbin holders for holding bobbins to which filaments are fed continuously, the device being mounted to move along the line of bobbin holders and comprising a support, a first arm, pivotal connecting means between said support and said first arm for said first arm to swivel towards and away from a selected bobbin holder in the line thereof, a first holding device mounted on said first arm for receiving a full bobbin from the bobbin holder and withdrawing the full bobbin therefrom, a second arm, pivotal connecting means between said first and second arms for said second arm to swivel towards and away from said first arm, a power driven friction roller mounted on said second arm for frictionally rotating the full bobbin when being withdrawn from the bobbin holder, a third arm, pivotal connecting means between said support and said third arm for said third arm to swivel towards and away from the bobbin holder, a second holding device mounted on said third arm for the guided transport of an empty bobbin to said bobbin holder, and means connected to said support for controlling the opening and closing of the bobbin holder to enable the bobbin therein to be exchanged.

2. A device according to claim 1, wherein said pivotal connecting means between said support and said first and third arms comprise in common a further arm mounted to swivel about a first axis on said support, said first and third arms being mounted to swing about a second axis on said further arm.

3. A device according to claim 1, wherein said first holding device is a forked assembly having arms, freely rotatable rollers mounted on said arms and resilient means acting on said arms, whereby said arms can resiliently embrace a bobbin axle engaged by said rollers.

4. A device according to claim 1, wherein said second holding device is a forked assembly having two arms and freely rotatable rollers for locating a bobbin axle between said arms.

5. A textile machine having a line of pivotally mounted bobbin holders for holding bobbins to which filaments are fed continuously, the bobbin holders having co-axial pivotal mountings, driving cylinders for the bobbins, said driving cylinders peripherally engaging the bobbins, resilient means acting on said bobbon holders to maintain the bobbins in engagement with said driving cylinders, and a device for bobbin-exchanging mounted to move along the line of bobbin holders and constructed according to claim 2, the device being mounted for said second axis to be brought into co-axial relationship with said pivotal mountings of said bobbin holders for exchanging a bobbin on a bobbin holder.

6. A textile machine according to claim 5, including a horizontal rail extending horizontally in front of the line of bobbin holders, and guide rollers mounted on said device and engaging said rail to enable said device to be moved along said rail.

7. A device according to claim 1, wherein said third arm includes a terminal portion pivoted to a main portion of said third arm, said second holding device being mounted on said terminal portion, said pivoted terminal portion having a first position in alignment with said main portion of said third arm and a second position folded upon said main portion, whereby said full bobbin can be withdrawn by said first arm from the bobbin holder past the empty bobbin when said terminal portion is in the first position and said empty bobbin may be transported by said third arm to said bobbin holder when said terminal portion is in the second position.

* * * * *